United States Patent [19]

Sonne

[11] 4,384,371

[45] May 24, 1983

[54] NURSING BONNET

[76] Inventor: Barbara A. Sonne, 304 Ellen, Hopkinsville, Ky. 42240

[21] Appl. No.: 210,580

[22] Filed: Nov. 26, 1980

[51] Int. Cl.[3] ..... A42B 1/06; A42B 1/20

[52] U.S. Cl. ..... 2/204; 2/104; 2/196; 2/DIG. 6

[58] Field of Search ..... 2/204, 202, 205, 196, 2/104, 172, 177, 198, DIG. 6

[56] References Cited

U.S. PATENT DOCUMENTS

| | | | |
|---|---|---|---|
| 284,511 | 9/1883 | Stern | 2/204 |
| 1,206,480 | 11/1916 | Stagg | 2/104 |
| 1,569,112 | 1/1926 | Bernstein | 2/204 |
| 2,624,052 | 1/1953 | Redlin | 2/204 |
| 2,685,091 | 8/1954 | Thill | 2/204 |
| 4,121,303 | 10/1978 | Reece | 2/205 |

FOREIGN PATENT DOCUMENTS

| | | | |
|---|---|---|---|
| 781682 | 3/1935 | France | 2/198 |
| 275147 | 5/1951 | France | 2/177 |

OTHER PUBLICATIONS

Gershman, "Self Adhering Nylon Tapes", 10-18-58, J.A.M.A., p. 930.

*Primary Examiner*—Peter P. Nerbun
*Attorney, Agent, or Firm*—Harvey B. Jacobson

[57] ABSTRACT

An article of wearing apparel in the form of a bonnet for use by infants when being breast fed which includes a unique structure that conceals the breast from view, thereby enabling a child to be breast fed in public without the mother exposing her breast to public view. The structure of the bonnet which enables this function to be advantageously obtained includes a relatively wide brim detachably connected to the forward edge portion of a conventional bonnet in which the width of the flexible brim is sufficient that the brim will conceal the breast while a child is being breast fed in public, thereby eliminating any embarrassment of a modest nursing mother and increasing the acceptance of women nursing babies in public places inasmuch as the breast will not be exposed to view by the public when breast feeding.

3 Claims, 3 Drawing Figures

NURSING BONNET

BACKGROUND OF THE INVENTION

1. Field of the Invention

The present invention generally relates to a garment, such as an article of headwear and more particularly a bonnet for use by infants or children of nursing age which includes a wide brim attached to the bonnet and having dimensional characteristics enabling it to substantially completely conceal the breast from public view when breast feeding, thereby enabling nursing mothers to breast feed her child in public places without embarrassment to her and without objection by others in the vicinity since the breast will be concealed by the brim on the nursing bonnet of the present invention.

2. Description of the Prior Art

Conventional bonnets adapted for use by infants and young children are usually provided with a flexible brim which has a relatively narrow width and functions primarily as a decorative item, although it also functions to shade the face and eyes and otherwise function in the manner intended. The following U.S. patents are illustrative of the known structures relating to bonnets: U.S. Patent Nos.:

284,511—Sept. 4, 1883
918,511—Apr. 20, 1909
1,569,112—Jan. 12, 1926
1,598,287—Aug. 31, 1926
2,578,219—Dec. 11, 1951
2,685,091—Aug. 3, 1954.

While the above-mentioned patents disclose conventional bonnets with a brim, it is noted that the width of the brim is proportional to the size of the cap portion of the bonnet so that it will serve as a decorative adornment and as a shade or protector for the face and eyes of the child wearing the bonnet. None of the above-mentioned patents discloses any type of attachable, relatively wide flexible brim capable of being detachably connected to either the existing brim or existing cap portion of the bonnet.

SUMMARY OF THE INVENTION

An object of the present invention is to provide a nursing bonnet having an attachable, wide, flexible brim connected to a conventional bonnet and having dimensional characteristics enabling the brim to cover and conceal a breast of a nursing mother when the wearer of the bonnet is being breast fed.

Another object of the invention is to provide a nursing bonnet in which the attachable brim is connected thereto by the use of a strip of "Velcro" with one portion being attached to the existing bonnet and the other portion being attached to the attachable brim.

A further object of the invention is to provide a nursing bonnet in accordance with the preceding objects in which the attachable brim is constructed of the same fabric and has appearance characteristics the same as or compatible with the bonnet to which it is attached.

Still another object of the invention is to provide a nursing bonnet in accordance with the preceding objects in which the attachable brim extends substantially completely about the periphery of the bonnet so that the breast will be concealed completely about the periphery of the breast when a child is being breast fed.

Yet another important object of the present invention is to provide a nursing bonnet in accordance with the preceding objects which is simple in construction, effective for concealing the breast and associated area when breast feeding in public and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
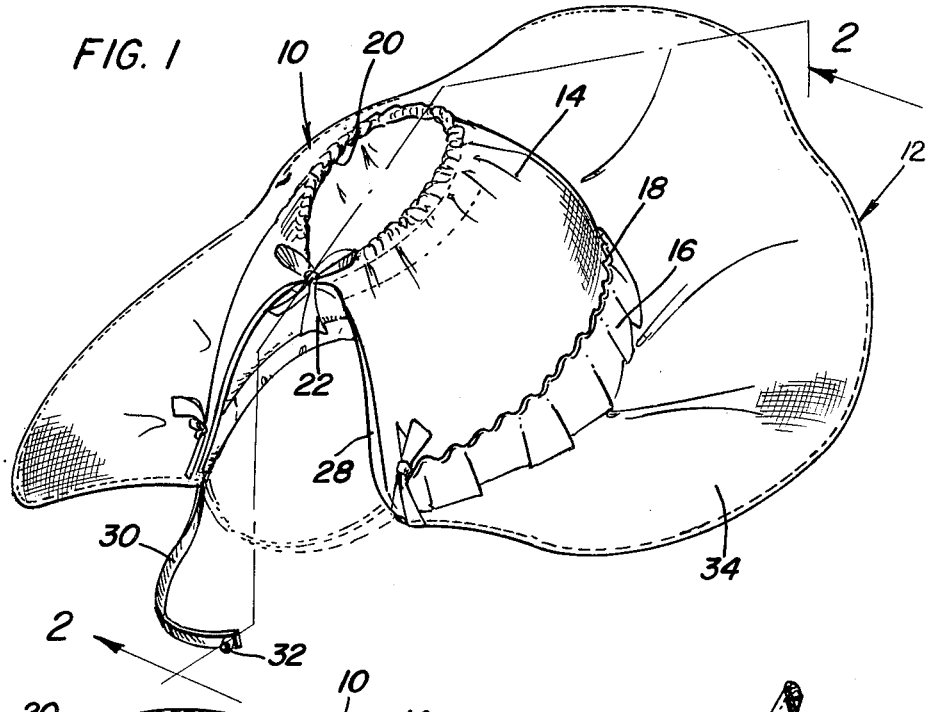
FIG. 1 is a perspective view of the nursing bonnet of the present invention with the wide brim attached thereto.

Referring now specifically to the drawings, the nursing bonnet of the present invention generally designated by the numeral 10 with the attachable brim being designated by the numeral 12. The bonnet 10 includes a cap portion 14 of conventional construction with the cap portion 14 being constructed of fabric or the like. As occurs frequently, the cap portion includes a forward peripheral brim 16 of decorative configuration which may be lace, gathered material, or the like, that is separated from the remainder of the cap portion by stitching, piping, or the like, 18 which represents conventional bonnet structure. Also, the rear of the bonnet is usually provided with either an opening 20 or a closure panel depending upon the style of the bonnet. If an opening is provided, it usually is retained in partially closed position by a ribbon or cord 22 received in a hem 24 surrounding the opening 20 so that the size of the opening can be varied by using the ribbon or cord 22 as a draw string, thereby enabling the opening to be completely closed, such as in cold weather, or adjusted to any desired size to enable the cap portion 14 to more nearly conform with and properly fit the head 26 of an infant or young child wearing the bonnet 10. Extending from the rear opening 20 or closure panel, if used, the cap portion 14 is provided with a neck receiving area delineated by a pair of finished edges 28 which straddle and receive the neck area 29 of the infant with a chin strap 30 being connected to the forward end of one of the edges 28 and detachably connected to the forward end of the opposite edge such as by a snap fastener arrangement 32, button, "Velcro" or any other suitable fastening device. In some instances, the chin strap may be in the form of a ribbon or decorative item, a resilient member and of any suitable fabric or similar material. All of the aforementioned described structure of the bonnet, except for the attachable brim 12, is of conventional construction.

Figure 3:
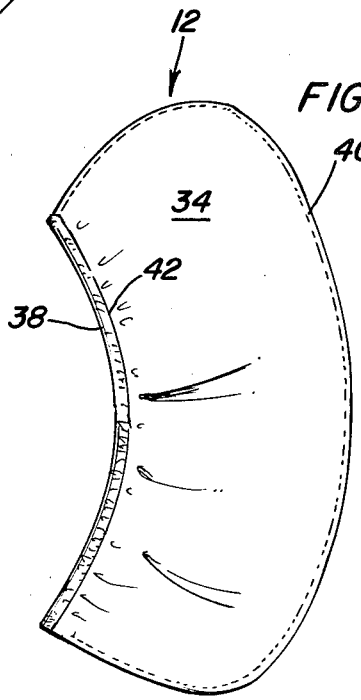
FIG. 3 is a plan view of the attachable brim.

The attachable brim 12 is a wide and elongated panel 34 of fabric material which is generally flexible and may be the same material as the cap portion 14 of the bonnet or it may be contrasting or compatible with the remainder of the bonnet depending upon the individual desires of the person using the bonnet. At the juncture between the cap portion 14 and the conventional narrow brim portion 16, a strip 36 of "Velcro" is attached such as by the stitching 18 with the strip 36 being the fleece or loop portion of the "Velcro" fastening strip. Thus, even if the interior surface of the fastening strip 36 comes into contact with the surface of the head 26, it will not scratch or otherwise irritate the skin. The inner edge of the panel 34 is provided with a fastening strip 38 which is the harder, hook portion of the "Velcro" fastening strip so that when the two strips 36 and 38 are interconnected, they are of substantially the same length and will effectively secure the panel 34 to the cap portion 14 throughout the periphery thereof, as illustrated in FIG 1. When the structure of the panel 34 is formed, the peripheral edge will have a hem 40 formed therein and provided with lace or other decorative material, if desired. Also, the edge thereof having the fastening strip 38 secured thereto will be gathered as at 42 to produce a generally arcuately shaped attachable brim 12 as illustrated in FIG. 3 so that it will conform with the periphery of the cap portion 14 and project peripherally from all portions of the cap portion 14 when assembled therewith as illustrated in FIG. 1.

Figure 2:
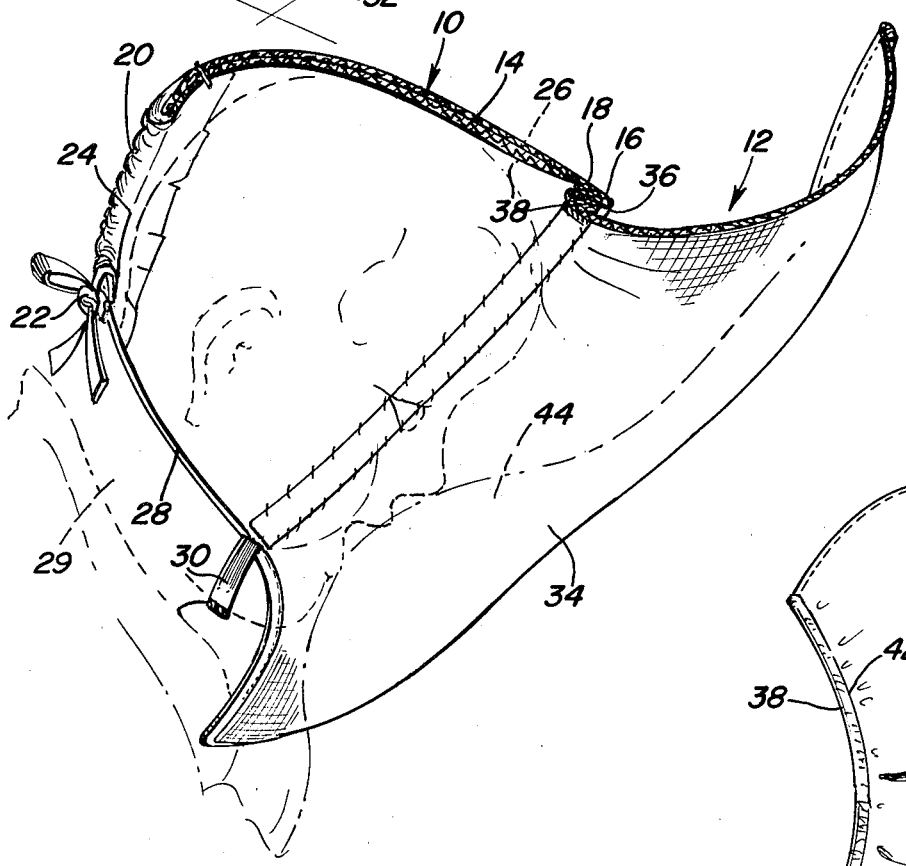
FIG. 2 is a sectional view, taken substantially upon a plane passing along section line 2—2 of FIG. 1 illustrating schematically the relationship of the bonnet and wide brim to a child and breast when breast feeding.

Various types of ruffles, lace, piping, bias tape, and the like, may be incorporated into the bonnet and into the attachable brim 12 in order to provide the desired decorative and functional characteristics to the device. When the nursing bonnet is to be converted from a conventionally appearing bonnet, that is without the attachable brim 12 connected thereto, it can be either removed from the infant's head or the chin strap at least loosened and the fastening strip 38, which is facing upwardly, connected to the fastening strip 36 by finger pressure longitudinally along the two strips. Then the nursing bonnet is either placed back on the head or the chin strap reattached or tightened and the nursing bonnet is then ready for use. As illustrated in FIG. 2, the wide brim 12 completely covers the breast 44 and surrounding area of the nursing mother so that both the mother and baby are comfortable and the mother can be confident that her breast is not exposed and cannot be observed by others. This will enable a mother to breast feed her child in public without embarrassment and will render public breast feeding more acceptable. Further, the nursing bonnet is convenient and compact inasmuch as the bonnet may be used in a conventional manner without the brim 12 attached with the brim only being attached when it is desired to breast feed. This eliminates the worry that a mother may have of offending someone due to breast exposure since the breast will be completely covered and concealed from public view when breast feeding. In addition, the large brim provides more effective sun protection for the child, especially when in a stroller, carriage, or the like, when a child frequently is inclined rearwardly and may be exposed to direct sun rays.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a bonnet for use by infants comprising a cap portion enclosing a substantial portion of the head area rearwardly of the face, means releasably securing the cap portion in position on the head of the wearer, said cap portion including a forward peripheral edge disposed generally along the periphery of the facial area of the wearer, a wide brim extending only forwardly and outwardly from the forward peripheral edge of the cap portion, and means detachably securing the wide brim to the cap portion of the bonnet thereby enabling the bonnet to be converted to one having a wide brim to conceal the facial area and mouth area of the wearer as well as the breast and surrounding area of a nursing mother when the wearer of the bonnet is being breast fed, said wide brim being constructed of flexible material to enable the brim to generally conform with and engage the areas around the breast of a breast feeding mother to conceal such areas when breast feeding an infant.

2. The combination as defined in claim 1 wherein the means attaching the inner edge of the wide brim to the cap portion includes continuous strips of "Velcro" fastener material, with the softer loop portion attached to the cap portion and the harder hook portion attached to the brim with the inner edge of the wide brim underlying the peripheral edge of the cap portion.

3. The combination as defined in claim 2 wherein the cap portion includes a narrow brim around a major portion of its forward peripheral edge with the softer loop portion of the strip of fastener material being attached to the narrow brim thereby enabling the cap portion and narrow brim to be worn as a conventional bonnet without the wide brim attached, said narrow brim and the inner edge of the wide brim being coextensive in length.

* * * * *